US005558217A

United States Patent [19]

Focke et al.

[11] Patent Number: 5,558,217

[45] Date of Patent: Sep. 24, 1996

[54] HINGE-LID PACK FOR CIGARETTES

[75] Inventors: Heinz Focke; Heido Spöring, both of Verden, Germany

[73] Assignee: Focke & Co. (GmbH & Co.), Verden, Germany

[21] Appl. No.: 355,343

[22] Filed: Dec. 12, 1994

[30] Foreign Application Priority Data

Dec. 14, 1993 [DE] Germany ..... 43 42 523.2

[51] Int. Cl.[6] ..... B65D 85/10

[52] U.S. Cl. ..... 206/268; 206/86; 206/87; 206/265

[58] Field of Search ..... 206/86, 87, 268, 206/265, 271, 273

[56] References Cited

U.S. PATENT DOCUMENTS

| | | | |
|---|---|---|---|
| 3,039,671 | 6/1962 | Chiamardas | 206/268 |
| 3,404,770 | 10/1968 | Peery . | |
| 3,976,194 | 8/1976 | Loredo | 206/87 |

FOREIGN PATENT DOCUMENTS

| | | |
|---|---|---|
| 2593474 | 7/1987 | France . |
| 2301984 | 7/1974 | Germany . |
| 7719461 | 11/1977 | Germany . |
| 8002488 | 7/1980 | Germany . |
| 9106739 | 11/1992 | Germany . |
| 1086725 | 10/1967 | United Kingdom . |
| 2236737 | 4/1991 | United Kingdom . |

*Primary Examiner*—David T. Fidei
*Attorney, Agent, or Firm*—Sughrue, Mion, Zinn, Macpeak & Seas

[57] ABSTRACT

Hinge-lid packs for cigarettes have a standard structure. To increase the functional value, a lighter (33) is disposed within a chamber (32) which is separated from the cigarette block (10). The walls for delimiting the chamber (32) are formed from the same blank as the collar (28) such that, as in a conventional hinge-lid pack, outer front edges (38, 39) are formed for supporting or guiding the lid (12) in the closing position. Because of the lesser height of the lighter (33), a base (44) is formed in the chamber (32) on a bottom wall (17).

8 Claims, 3 Drawing Sheets

HINGE-LID PACK FOR CIGARETTES

BACKGROUND OF THE INVENTION

The invention relates to a hinge-lid pack for the accommodation of a cigarette block, comprised of a box part, a lid which is hingedly connected to the rear wall thereof, and a collar attached to the box part having a collar front wall and collar side tabs, a chamber for the accommodation of a lighter to another article being delimited from the cigarette block and next to the cigarette block by means of a collar side tab.

Hinge-lid packs are widespread as packs for cigarettes. The structure of packs of this type is identical to a large extent. In the development of new designs or improvements of this pack type it is an important aim not to change the outer appearance and the details important for the handling of the pack.

SUMMARY OF THE INVENTION

The invention is based on the object to improve a hinge-lid pack, thereby taking into account the foregoing rule, so that additional functions can be fulfilled.

To attain this object the hinge-lid pack according to the invention is characterized in that the chamber for accommodating the lighter or the like is delimited at least by a chamber front wall and an outer chamber side wall, the chamber front wall being flush with the collar front wall.

The hinge-lid pack thus, according to the invention, has the additional function to create, next to a cigarette group with an inner wrapping designed in the conventional manner, a separate space for a lighter which is designed and dimensioned in the usual manner. The chamber for the lighter is separated from the cigarette group in the region of the collar, specifically by means of an insert which delimits the chamber at the level of the collar on the side of the front wall of the box part, and preferably also in the region of a side wall. The insert is preferably designed with a U-shaped cross section having a front wall and side webs. The insert designed in this manner is connected with the collar in one piece, and thus forms a common blank therewith.

According to a further feature of the invention the free or clearance height of the chamber for the lighter is delimited by a base in the region of a bottom wall of the hinge-lid pack. The lighter rests on the base. As a result, the lighter assumes a relative position which allows an easy withdrawal from the pack.

Further features of the invention relate to details of the hinge-lid pack. An exemplary embodiment will be explained in the following with reference to the drawings. In these:

DESCRIPTION OF A PREFERRED EMBODIMENT

Figure 4:
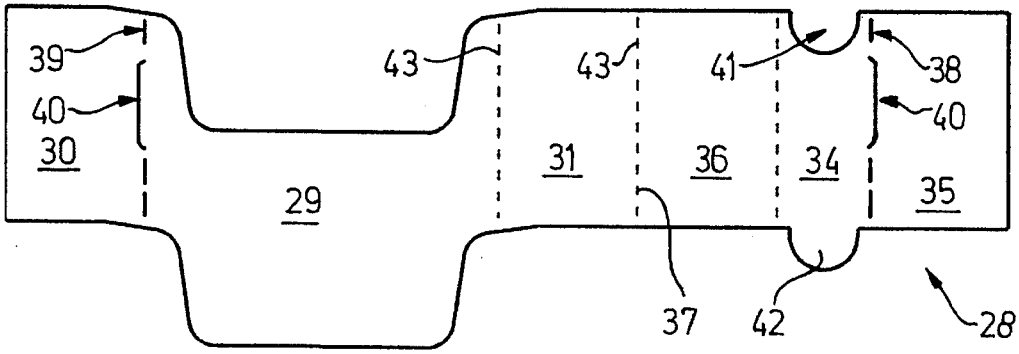
FIG. 4 shows a blank for a collar with an insert, also in the spread-out position.
Figure 1:
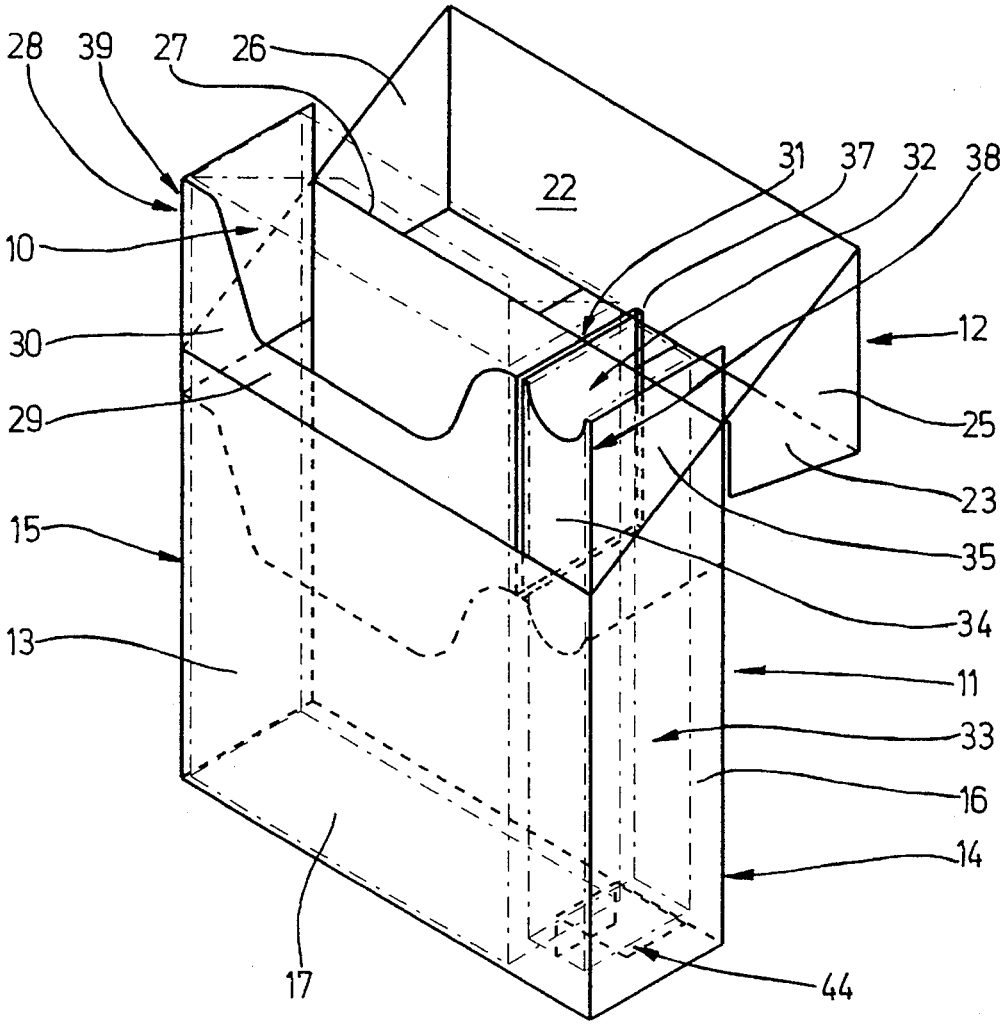
FIG. 1 shows an open hinge-lid pack in a perspective view.
Figure 2:
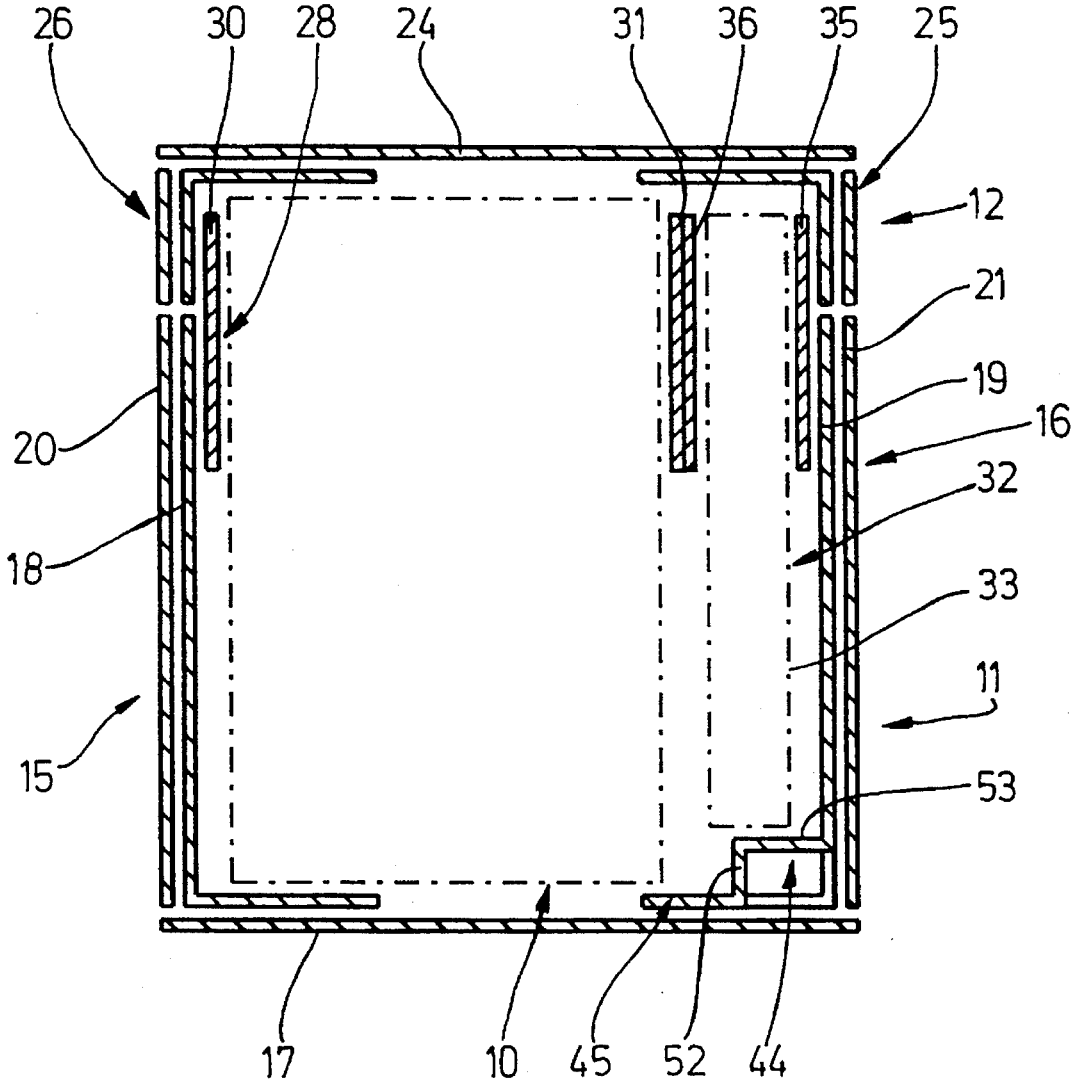
FIG. 2 shows a vertical section of a hinge-lid pack according to FIG. 1, in the closing position.
Figure 3:
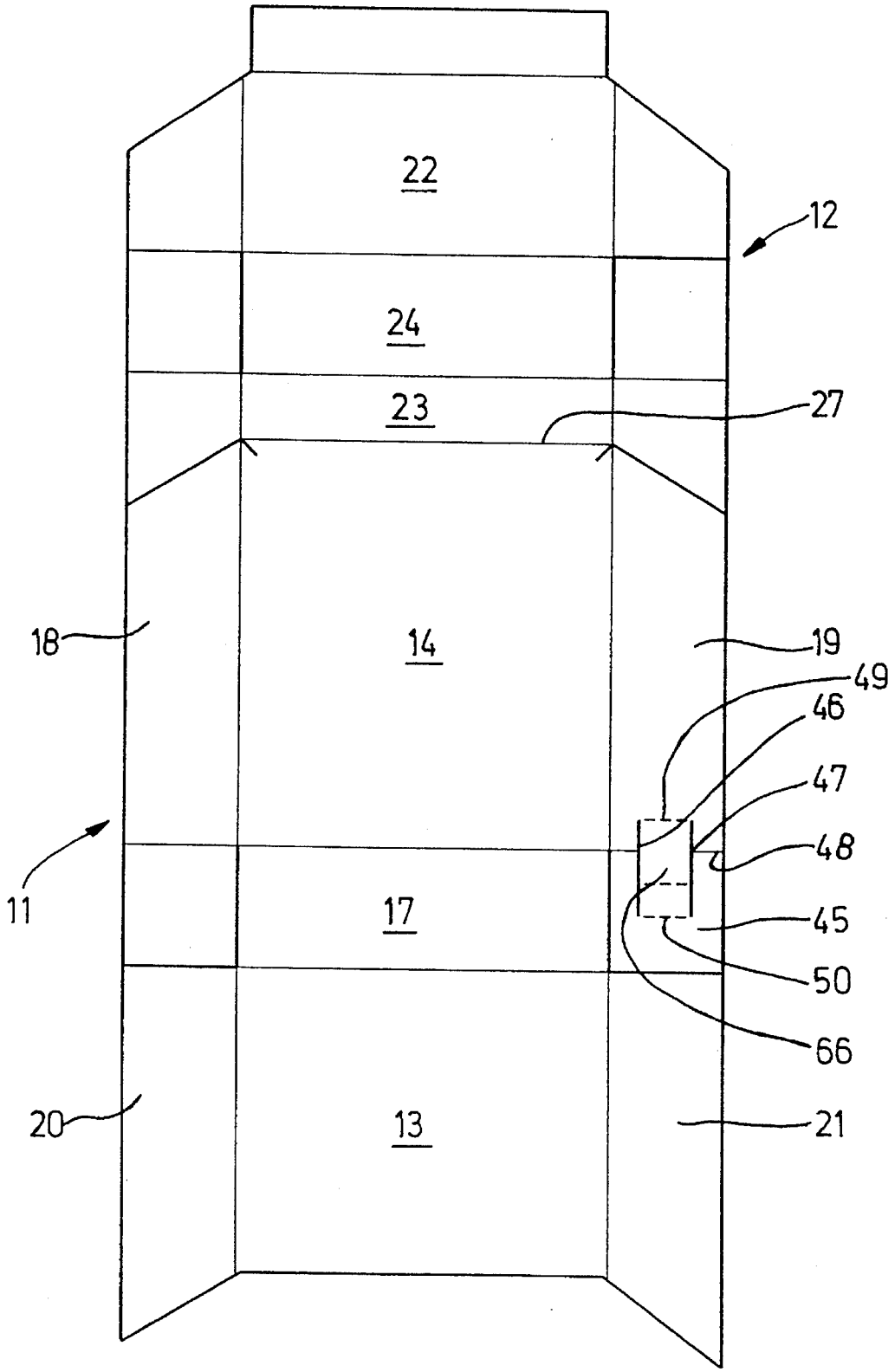
FIG. 3 shows a blank for a hinge-lid pack according to FIG. 1 and 2 in a spread-out position.

The shown embodiment relates to a hinge-lid pack for cigarettes (not shown in detail). A cigarette group, which forms the contents of the pack, is surrounded by an inner wrapping made of paper or tin foil and thus forms a cigarette block 10.

The hinge-lid pack is comprised of a box part 11, and a lid 12. The box part 11 has a front wall 13, rear wall 14, side walls 15 and 16, and a bottom wall 17. The side walls 15 and 16 are each formed from inner side tabs 18 and 19, and outer side tabs 20 and 21.

The lid 12 is hingedly connected to the rear wall 14 of the box part 11 in the region of the lid rear wall 23 via an articulated line 27.

A collar 28 having a collar front wall and transversely directed collar side tabs is arranged in the box part 11. The collar front wall 29 is attached to the inside of the front wall 13 of the box part 11. A collar side tab 30 abuts the inside of the side wall 15 of the box part and is attached thereto, if required, by means of adhesive bonding.

The collar 28, or the collar front wall 29 thereof has less width than the box part 11. As a result a chamber 32 is formed next to the collar side tab 31 within the hinge-lid pack or the box part 11. This chamber 32 has a depth which corresponds to the depth of the hinge-lid pack or the box part 11. The width is less such that outside of the chamber 32 a lighter 33 which has the usual dimensions can be accommodated. The lighter is question has the dimensions of the inexpensive mass-production lighters.

The chamber 32 is merely delimited at the level of the collar 28 by means of walls, specifically by means of a chamber front wall 34, a chamber side wall 35 and a chamber inner wall 36 which adjoins the collar 28. The height of these chamber walls corresponds to the height of the collar 28 or of the collar side tabs 30, 31. The chamber inner wall 36 abuts the outside of the collar side tabs 31. The chamber inner wall 36 and the collar side tab 31 are connected to one another via a common inner folding edge 37. This results in a continuous, one-piece blank for the collar 28 and the chamber walls 34, 35, 36. On the inside, and thus in the direction of the rear wall 14, the chamber 32 is merely delimited by the rear wall 14 and, in the closing position of the pack, by the lid rear wall 23.

The chamber front wall 34, together with the chamber side wall 35, forms an upright front edge 38 above the box part 11. This front edge 38 corresponds to front edge 39 of the collar 28. The two front edges 38, 39 are important for a hinge-lid pack because they align the lid 12 in the closing position. In the region of the front edges 38, 39, projections 40, which project from the edges, are formed by a U-shaped punch cut and function as projecting "ears" for abutting the inside of the lid 12.

To simplify the withdrawal of the lighter 33, the chamber front wall 34 is provided with a depression in the upper region, which leaves visible an upper end portion of the lighter 33.

In order to be able to produce the blank for the collar 28 and the chamber walls from a continuous blank in spite of the design of the chamber front wall 34, a tongue-shaped projection 42 is formed opposite of the depression 41. This results in the shape of the entire blank as shown in FIG. 4 which can be separated from a continuous web of material by punching without any waste. Folding edges are defined by means of perforation lines 43.

To ensure that a lighter 33 with a given standard height can be grasped in the upper region of the chamber 32, the chamber 32 has a smaller total height than the pack or the cigarette block 10. For this purpose a base 44 is formed in the chamber 32 on the bottom wall 17. This base is formed from a part of the blank for the hinge-lid pack. The inner side tabs 19 in the region of the chamber 32 are adjoined by a corner tab 45 which, as usual in conventional hinge-lid packs, abuts the bottom wall 17 of the box part 11. The corner tab 45, together with the adjoining side tab 19, forms the base 44. To this end two parallel punch cuts 46, 47 are provided which extend at a distance from one another and beyond a folding line 48 in the region of the corner tab 45 and the side tab 19. Transversely directed folding lines are formed at the ends of the punch cuts 46, 47 by means of perforations 49, 50. A further perforation 60 is located at a distance of the perforations 59, 60. When folding the corner tab 45 about 90°, a strip of material delimited by the punch cuts 46, 47 is folded inwardly, thereby forming the base 44 which has an upright supporting leg 52, and a horizontal supporting leg 53.

The hinge-lid pack designed in the described manner is expediently dimensioned such that it can be sold in cigarette vending machines. This means that the entire width of the pack is 67 mm. The cigarette block 10 has a width of 53 mm so that a conventional cigarette group with 20 cigarettes can be accommodated in the pack. The chamber 32 has a width of 12 mm.

We claim:

1. A hinge-lid pack for cigarettes for the accommodation of a cigarette block (10), said pack comprising:

a box part (11);

a lid part (12) which is hingedly connected to a rear wall (14) of the box part (11);

a collar (28) fixed in the box part (11) and having a collar front wall (29) and two collar side tabs (30, 31); and a chamber (32) for the accommodation of a lighter (33) and arranged next to the cigarette block (10);

wherein the chamber (32) is delimited against the cigarette block (10) by one (31) of the collar side tabs which is adjacent the chamber;

wherein in a region of the collar, the chamber (32) is delimited by a chamber front wall (34), a chamber outer side wall (35) and said one collar side tab (31), wherein the chamber front wall (34) is flush with the collar front wall (29), wherein an upright first front edge (38), formed by the chamber front wall (34) and a chamber side wall (35), corresponds to an opposite upright front edge (39) which is formed by the collar front wall (29) and the other collar side tab (30) which is located opposite the chamber (32), and wherein the chamber (32) has a depth which corresponds to that of the box part (11).

2. The hinge-lid pack as claimed in claim 1, wherein projections (40) for fixing the lid (12) in a closed position are arranged in a region of the front edges (38, 39).

3. The hinge-lid pack as claimed in claim 1, wherein the chamber outer side wall (35) rests against an inside of a pack side wall (16) of the box part (11), said pack side wall being formed from an inner (19) and an outer (21) side tab of a blank from which the pack is formed.

4. A hinge-lid pack for cigarettes for the accommodation of a cigarette block (10), comprising:

a box part (11);

a lid (12) which is hingedly connected to a rear wall (14) of the box part (11);

a collar (28) fixed in the box part (11) and having a collar front wall (29) and two collar side tabs (30, 31); and a chamber (32) for the accommodation of a lighter (33), being next to, and delimited from, the cigarette block (10) by one (21) of the collar side tabs;

wherein the chamber (32) for the accommodation of the lighter (33) is delimited at least by a chamber front wall (34) and a chamber outer side wall (35), the chamber front wall (34) being flush with the collar front wall (29), wherein the chamber (32) is additionally delimited by a chamber inner side wall (36) which abuts the adjoining said one collar side tab (31) and which is connected thereto via a folding edge (37) facing towards said rear wall (14) of the pack, wherein the collar (28) and said front and side walls of the chamber (32) are made from a one-piece blank in which said one collar side tab (31) and said chamber inner side wall (36) are connected to one another via said folding edge 37, and wherein the chamber front wall (34) is provided on one side with an upper depression (41) and, below on the other side, with a projection (42) correspondingly formed such that the entire one-piece blank can be severed from a continuous web of material without waste.

5. The hinge-lid pack as claimed in claim 4 wherein the chamber outer side wall (35) abuts an inside of a side wall (16) of the box part (11).

6. The hinge-lid pack as claimed in claim 1, wherein the chamber (32) is additionally limited by a chamber inner side wall (36) which abuts the adjoining said one collar side tab (31) and which is connected thereto via a folding edge (37) facing towards said rear wall (14) of the pack.

7. The hinge-lid pack as claimed in claim 6, wherein the collar (28) and said front and side walls of the chamber (32) are made from a one-piece blank in which said one collar side tab (31) and said chamber inner side wall (36) are connected to one another via said folding edge (37).

8. The hinge-lid pack as claimed in claim 3, wherein a base (44) for supporting the lighter (33) is formed in the chamber (32) in a region of a common bottom wall (17) by an angularly folded corner tab (45) which is connected to the inner side tab (19) of the pack side wall (16).

* * * * *